United States Patent [19]

Parsons et al.

[11] Patent Number: 4,572,701

[45] **Date of Patent: * Feb. 25, 1986**

[54] UNIVERSAL CONCRETE SCREED SYSTEM

[75] Inventors: Albert Parsons; H. Norris Havens, both of Columbia, S.C.

[73] Assignee: Consolidated Systems, Inc., Columbia, S.C.

[ * ] Notice: The portion of the term of this patent subsequent to Jan. 31, 2001 has been disclaimed.

[21] Appl. No.: 535,112

[22] Filed: Sep. 23, 1983

[51] Int. Cl.[4] ..... E01C 11/02

[52] U.S. Cl. ..... 404/50; 404/68

[58] Field of Search ..... 404/50, 51, 68; 249/3-9; 52/155

[56] References Cited

U.S. PATENT DOCUMENTS

| | | | |
|---|---|---|---|
| 1,345,179 | 6/1920 | Heltzel | 249/3 |
| 1,629,754 | 5/1927 | White | 404/50 |
| 3,057,269 | 10/1962 | Artigalas et al. | 404/50 |
| 3,401,612 | 9/1968 | Tone | 249/3 |
| 3,437,018 | 4/1969 | Jackson | 404/50 |
| 3,497,172 | 2/1970 | Welch | 404/51 X |
| 3,561,721 | 2/1971 | Self | 249/3 X |
| 4,012,159 | 3/1977 | Berry | 404/50 X |
| 4,428,556 | 1/1984 | Parsons et al. | 249/3 |
| 4,443,981 | 4/1984 | Weiss | 404/68 X |

*Primary Examiner*—Stephen J. Novosad
*Assistant Examiner*—Matthew Smith
*Attorney, Agent, or Firm*—L. Lawton Rogers, III

[57] ABSTRACT

A system of forms for facilitating the pouring of concrete into slabs, including a single "universal" screed stake with four vertically spaced pairs of fingers for selective use with screeds of four different vertical dimensions, each of the pairs of fingers receiving the lower edge of one of the screeds with the top of the stakes being received in a downwardly opening pocket formed by a hem on the upper edge of the screed. A novel stake configuration including the shape and location of the fingers and the curvature of the stake at the upper end thereof is dislcosed as is a novel screed construction including the pocket formed at the upper edge thereof and the skirt at the bottom edge thereof. Together, the screed and stakes cooperate to retain the screed on the stakes.

31 Claims, 13 Drawing Figures

UNIVERSAL CONCRETE SCREED SYSTEM

BACKGROUND OF THE INVENTION

This invention relates to a system for forming the joints of concrete slabs used in the construction of roadways, floors and the like. The basic system of forms, including screed and screed stakes, is well known and is illustrated, for example, in the Artigalas, et al. U.S. Pat. No. 3,057,269, dated Oct. 9, 1962, the Tone, et al. U.S. Pat. No. 3,357,324, dated Dec. 12, 1967, the Self U.S. Pat. No. 3,561,721, dated Feb. 9, 1981, the Tone U.S. Pat. No. 3,401,612, dated Sept. 17, 1968, the Welsh U.S. Pat. No. 3,497,172, dated Feb. 24, 1970, and the Berry U.S. Pat. No. 4,012,159, dated Mar. 15, 1977.

The screed stakes are generally made of metal, approximately 0.06 to 0.08 inches in thickness, approximately 1.00 to 1.25 inches in width and from 12 to 24 inches in length, depending upon the type of earth in which they are to be supported. Such stakes generally have a flat top and a pointed bottom to facilitate driving into the ground, as well as a longitudinal reinforcing bead or channel running from the pointed bottom to a point adjacent to the flat top. The flat top also facilitates insertion into a downwardly opening pocket formed on the top edge of the sheet metal screed with which the stakes are used. Such stakes may also be provided with upwardly opening pocket into which the lower edge of the screed may be inserted. In practice, this pocket often takes the form of one or more "fingers" formed out of the stake metal and extending upwardly alongside the stake.

The vertical depth of the concrete slabs being poured, and thus the vertical width of the screed necessary to form the key joint in the slab, differs substantially with the four typical dimensions being 3.5, 4.5, 5.5 and 7.5 inches. With generally known systems, it has been necessary to maintain an inventory of stakes with fingers at different distances from the top end of the stake, so that a screed of the desired vertical dimensions may be secured to the stake. The maintenance of this inventory of stakes is costly, not only in the initial cost of procuring the stakes, but in the manpower necessary to maintain their separation and in the storage space needed in the transportation to and storage thereof at the construction site. The need for a "universal" stake which may be used with screeds with differing vertical dimensions has been long recognized.

Known attempts to provide a stake for use with more than one dimension of screed have included the location of a single finger on opposite sides of the central reinforcing bead in the stake at two different vertical heights. Such single finger stakes have the disadvantage in that the holding capabilities of the single finger are limited and in addition may permit an undesirable rotation between the screed and stake. In addition, two different stakes with the four standard concrete slab depths are generally required.

It has also been known to utilize the screed receiving fingers in pairs at a given vertical distance from the top edge thereof. However, the use of pairs of fingers at multiple depths has presented two problems, i.e., (1) the stake has been impermissibly weakened by the cutting of the metal to form the multiple fingers and (2) the location of the fingers for dimensions of screed other than the one in actual use has interfered with the securing of the screed to the stake.

More recently, applicants have devised a "universal" stake provided with three pairs of fingers, with one of the pairs of fingers serving to receive the bottom edge of two different widths of screed. In this system where two different widths of screed use a common pair of fingers, the top of the stake is received in the downwardly opening pocket of one of the two screeds, and the top of the stake passes through a slot in the screed channel when in use with the other dimension of screed. This system is described and claimed in applicant's pending application Ser. No. 376,608, filed May 10, 1982, now U.S. Pat. No. 4,428,556, dated Jan. 31, 1984, and assigned to the assignee of the present invention.

It is a primary object of the present invention to obviate the deficiencies of known systems and to provide a novel system having a single novel "universal" stake usable with each of four novel screeds of standard widths, as well as a novel method of securing the screed to the stakes.

The advantages of the present system will be readily apparent to one skilled in the art from the claims and from the following detailed description when read in conjunction with the accompanying drawings.

THE DRAWINGS

Figure 1:
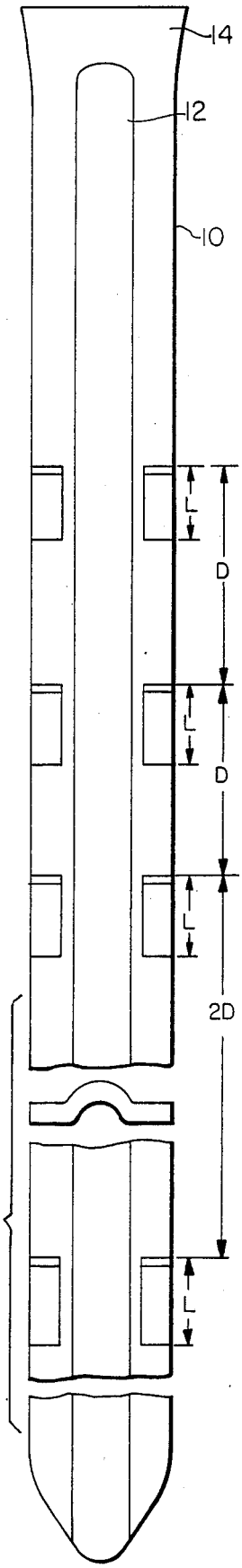
FIG. 1 is a front elevation view of one embodiment of the novel stake of the present invention.
Figure 2:
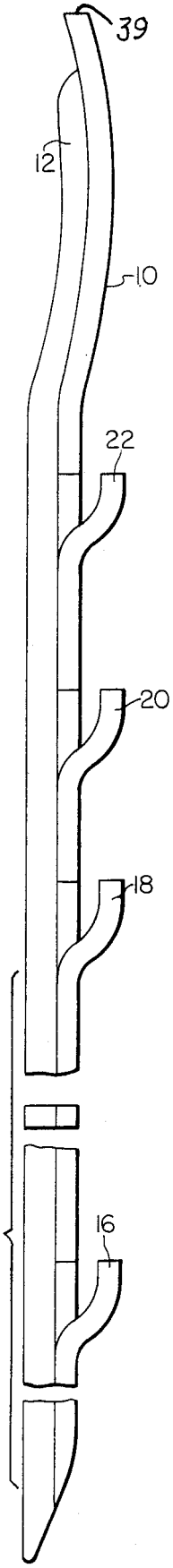
FIG. 2 is a side elevation view of the stake of FIG. 1.
Figure 5:
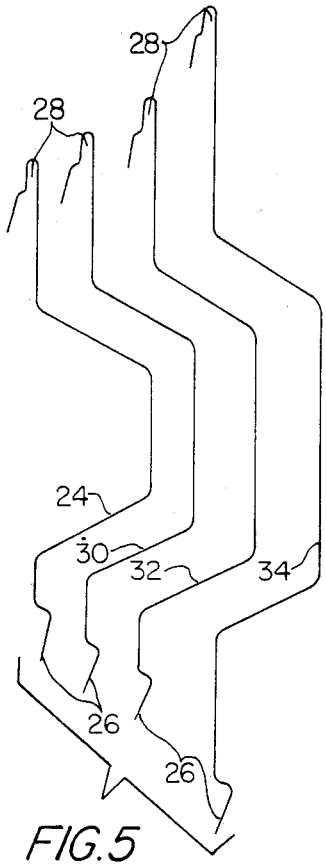
FIG. 5 is a pictorial representation of the relative dimensions of one embodiment of four sizes of screed which may be used in the system of the present invention.
Figure 8:
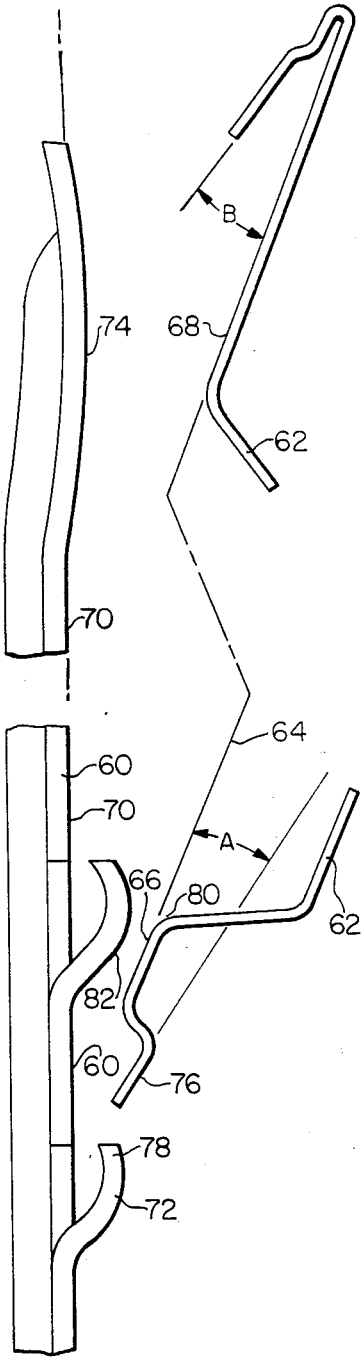
Figure 9:
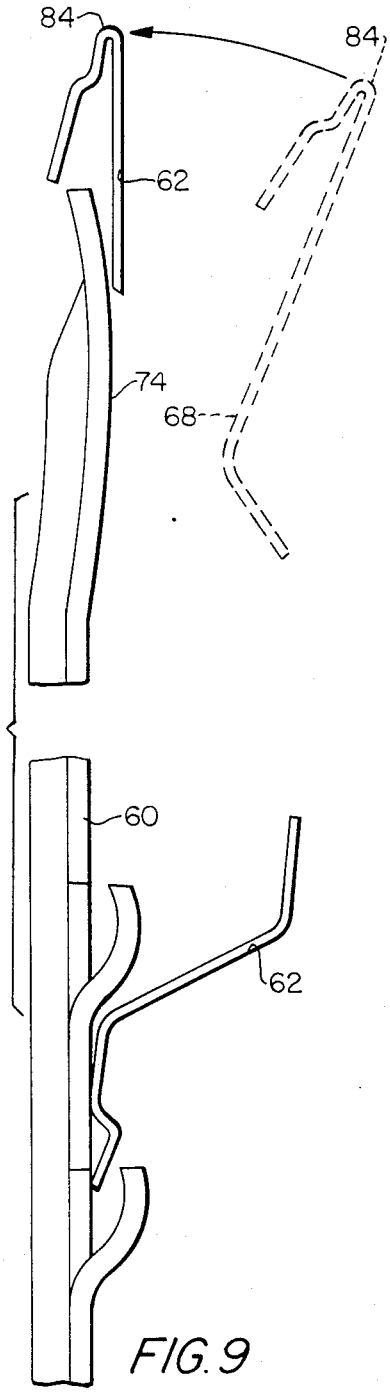
Figure 10:
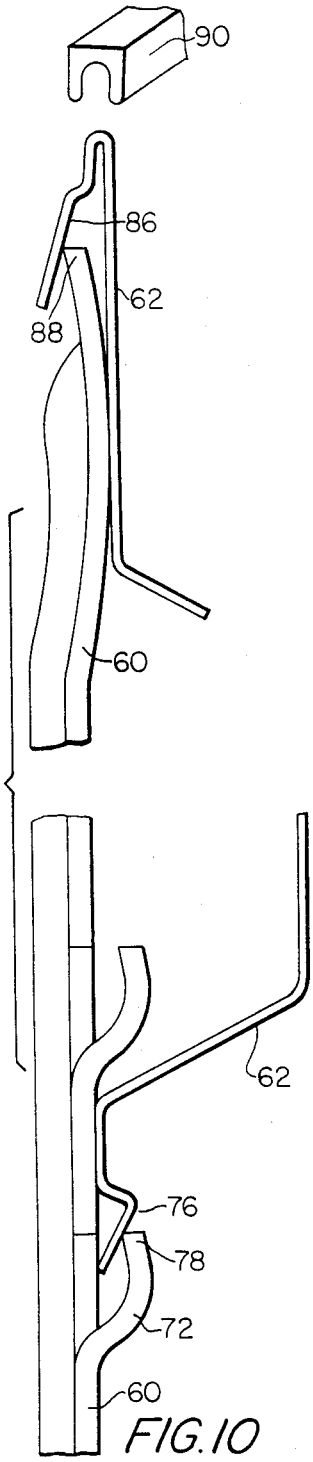
Figure 11:
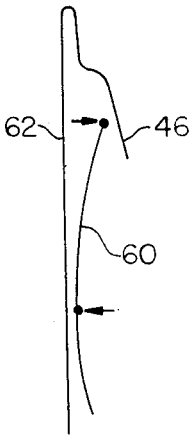
Figure 12:
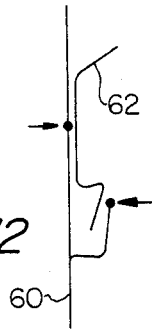
Figure 13:
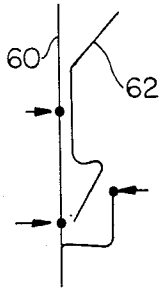

FIGS. 8, 9, and 10 are side elevation views of portions of the stake of FIGS. 1 and 2 and the screed of FIG. 5 illustrating a method of securing the screed to a line of stakes; and FIG. 11 is a schematic illustration of the frictional binding action of the screed to the stake at the upper edge of the screed;

FIG. 12 is a schematic illustration of the frictional binding action of one embodiment of screed to the stake at the lower edge of the screed; and FIG. 13 is a schematic illustration of the frictional binding action of a second embodiment of the screed to the stake at the lower edge of the screed.

DETAILED DESCRIPTION

With reference to FIGS. 1 and 2 where a preferred embodiment of the stake of the present invention is illustrated, the stake 10 may be made of flat steel of approximately 0.07 inches in thickness and may be formed with a central reinforcing bead 12 approximately 0.5 inches wide and 0.25 inches deep. The finished width of the stake is approximately 1.25 inches, but may be slightly larger at the upper end 14 thereof in the area where the reinforcing bead 12 does not extend. The length of the stake may be varied as a function of the anticipated soil conditions into which the stake is to be driven, i.e., typical lengths are 12 inches, 15 inches, 18 inches and 24 inches.

With continued reference to FIGS. 1 and 2 where like numerical indications have been applied to like elements, the stake 10 is provided with four vertically spaced pairs of "fingers", with one pair of fingers 16, 18, 20, and 22 located respectively to form a pocket approximately 7.5, 5.5, 4.5 and 3.5 inches from the top of the stake.

As shown in FIGS. 1 and 2, each of the fingers 16, 18, 20, 22 may be the same length L with a distance D between like points on vertically adjacent fingers being the same for the uppermost three pairs of fingers 18, 20, 22, i.e., about one inch. The distance between the two lowermost pairs of fingers 16, 18 is approximately twice that between the other pairs of fingers 18, 20, 22.

Note that the upper three pairs of fingers are found on the stake 10 within a space equal to (2 D+L), or slightly less than 2.5 D. Note also that all four pairs of fingers are found on the stake 10 within a space equal to (4 D+L), or slightly less than 4.5 D. The location of all four pairs of fingers within this distance is possible without impermissibly weakening the stake because the length L of each finger is significantly reduced, a reduction which is in turn possible because of the unique configuration and interaction of the screed and stake as is subsequently discussed in greater detail.

Figure 3:
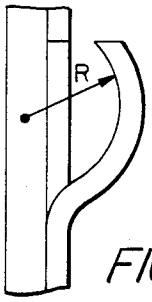
FIG. 3 is an enlarged side elevation view of the fingers of the stake of FIGS. 1 and 2.
Figure 4:
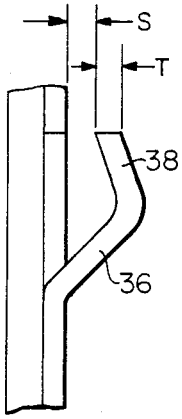
FIG. 4 is a side elevation view of a second embodiment of the fingers of the stake of FIGS. 1 and 2.

As shown in greater detail in FIG. 3, each of the fingers 16, 18, 20, and 22 of FIGS. 1 and 2 may be formed into a generally arcuate shape having a radius R of about 0.25 inches. An alternative configuration of the fingers of the stake of FIGS. 1 and 2 is illustrated in FIG. 4 where the finger is formed of a generally upwardly and outwardly portion 36 integral with the stake and an upwardly and inwardly portion 38. In both cases, the free end of the finger is spaced a distance S from the stake less than the thickness T of the stake and is upwardly and inwardly inclined with respect to the stake for reasons subsequently explained in greater detail.

With reference again to FIG. 2, it is apparent that the portion of the stake 10 above the uppermost pair of fingers 22 is generally curved toward the finger side of the stake with the flat top 39 thereof disposed desirably in the approximate plane of the stake. The radius of curvature of this bend may be, e.g., approximately 3.5 to 4.5 inches.

The four standard sizes of screed are illustrated in FIG. 5. As shown in FIG. 5, the stake of FIGS. 1 and 2 may be used with a screed 24 of 3.5 inches in depth by inserting the lower edge 26 thereinto the pocket formed by the fingers 22 and by receiving the top 39 of the stake in the pocket 28 formed at the upper edge thereof. Likewise, the stake of FIGS. 1 and 2 may be used with a screed 30, 32, or 34 with the lower edge 26 thereof respectively received within the pairs of fingers 20, 18, and 16, and with the top 39 of the stake received within the pocket 28 formed at the upper edge 28 thereof.

With continued reference to FIG. 5, it may be seen that the lower portions of the three narrowest screed, including the skirt, are desirably the same, e.g., about 0.78 inches, while the upper portion desirably increases proportionally to the width or vertical height of the screed, e.g., about one-third of the total increase. The other two-thirds of the total increase for all but the 7.5 inch screed is absorbed in the central channel portion. However, the more substantial total increase between the 5.5 and 7.5 inch screed is uniformly spread among the three portions.

Figure 6:
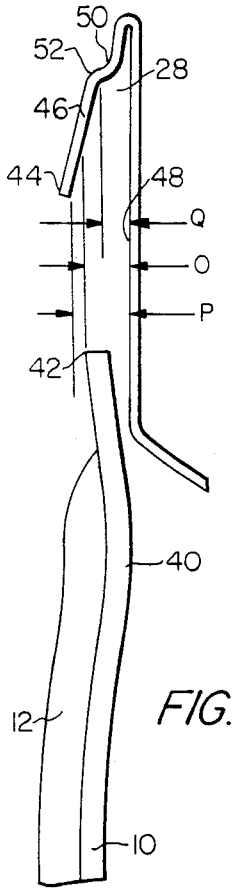
FIG. 6 is a side elevation view of the top portion of the stake of FIGS. 1 and 2 in proximity to the upper edge of the screed illustrated in FIG. 5.

As shown in greater detail in FIG. 6, the pocket 28 is formed by a downwardly extending hem having a first portion 50 immediately alongside the screed, a second portion 52 extending away from the screed, and a third and terminal portion 46 extending downwardly and away from the screed. Note that the distance O between the point 40 of greatest lateral projection toward the screed and the edge 42 of the flat top of this stake on the side thereof facing away from the screed is less than the spacing P between the free end 44 of the pocket 28 formed at the upper edge of the screed. This distance O, however, is greater than the distance Q where the inclined portion 46 of the pocket begins. This ensures that the edge 42 on the top 39 of the stake 10 will pressurally engage the inner surface of the inclined portion 46 of the hem as the pocket 28 of the screed is forced downwardly over the top of the stake with the upper flat portion 48 of the screed in contact with the projection 40 of the stake.

The inclined portion 46 of the pocket of the screed is desirably resilient, as subsequently explained, but has sufficient rigidity to ensure that the top of the screed cannot be inserted between screed and the portion 50. This spring-like effect is enhanced by the configuration of the hem in the first portion 50, and outwardly extending second portion 52.

Figure 7:
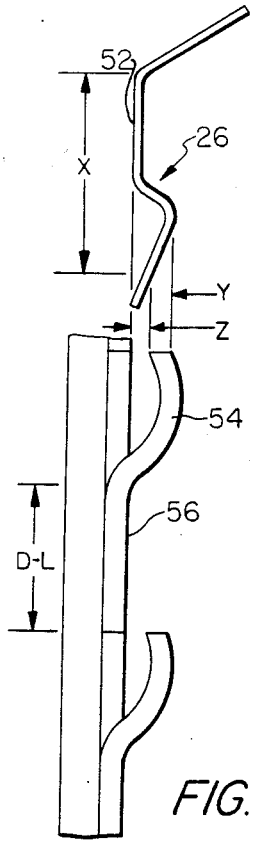
FIG. 7 is a side elevation view of an intermediate portion of the stake of FIGS. 1 and 2 in proximity to the lower edge of the screed illustrated in FIG. 5.

With reference to FIG. 7, the lower edge 26 of the screed includes a flat surface 52 generally coplanar with the surface 48 of the upper portion thereof. This lower edge of the screed 26 may be formed into a surface inclined towards the plane of the surfaces 52 and 48.

With continued reference to FIG. 7, the lower edge 26 of the screed will be received within the pocket formed by the finger 54. As may be seen from FIG. 7, the distance X is desirably slightly less than the distance (D−L) with the spacing Y greater than the opening Z between the free end of the finger 54 and the surface 56 of the stake out of which the finger 54 is formed.

The operation of the system may be more readily understood by reference to FIGS. 8, 9 and 10. As illustrated in FIG. 8, a line of stakes 16 may be driven into the ground to the desired depth and the appropriate screed 62 for that depth brought into proximity to the line of stakes. As illustrated in FIG. 8, the plane 64 of the screed, i.e., the plane passing through the generally coplanar flat surfaces 66 and 68, is inclined to the plane of the plane 70 of the stake, by an angle of about thirty degrees.

As shown in FIG. 8, the inclined skirt 76 on the lower edge of the screed 62 is at an angle A to the plane of the screed. As shown in FIG. 8, this skirt 76 may be inserted between the free end 78 of the fingers 72 and the surface 70 of the stake. There is desirably a camming action which results from the engagement of the elbow 80 on the outer surface 82 of the fingers which facilitates the positioning of the screed 62 relative to the stake 60, as illustrated in the lower portion of FIG. 9.

As the lower edge of the screed is downwardly inserted within the pocket formed by the stake 72, the top portion 84 of the screed moves from the position illustrated in dotted lines in FIG. 9 to the position shown in solid lines. Once in the position illustrated in FIG. 9, the screed 62 may be pressed downwardly over the stake to simultaneously move the inclined surface 76 of the skirt of the screed into contact with the free end 78 of the finger 72 and the inner inclined surface 86 into contact with the flat top 88 of the stake.

As illustrated in FIG. 10, a secure attachment of the screed 62 to the stake 60 is ensured by the engagement of the curved surfaces 74 and 68 (seen in FIGS. 8 and 9), and by the engagement of the top 88 of the stake with the inclined surface 86. As shown schematically in FIG. 11, the horizontal forces exerted by the stake 60 on the screed 62 provide a force couple tending to flex the inclined portion 46 of the screed hem away from the plane of the screed. It should be understood that measurable movement is not required to stress the screed and stake sufficiently to establish the desired friction bind.

At the same time, and with continued reference to FIG. 10, the downward movement of the screed 62 relative to the stake 60 inserts the lower edge of the screed 62 into the pocket formed by the finger 72 of the stake sufficiently for pressural engagement between the inclined skirt 76 and the free end 78 of the finger 72. Note in FIG. 10 that the flat surface 66 of the lower portion of the screed 62 engages the flat surface 70 of the stake, (seen in FIG. 8), as may the free end of the inclined skirt 76.

As shown schematically in FIG. 12, the stake 60 exerts opposing lateral forces on the screed 62. Where the end of the skirt terminates in the plane of the screed, the stake 60 exerts three horizontal forces as shown in FIG. 13. These forces tend to flex the inclined skirt toward the plane of the screed and ensure a frictional bind between the screed and stake.

It should be recognized that the stake is generally much more substantial than the screed, and that deformation of the screed should therefore be expected before any deformation of the stake.

In addition to the wedging action and spring bias friction lock of the pocket of the screed over the top of the stake, and in addition to a similar relationship between the skirt at the lower edge of the screed with the ends of the fingers, these opposing lateral forces are supportive and provide a particularly secure frictional bind when acting in concert.

As also shown in FIG. 10, a conventional flexible screed cap 90 may be attached over the uppermost or closed portion of the pocket at the top of the screed. This screed cap may be removable or nonremovable as desired. Note that the configuration of the pocket eliminates entry of the flat top 88 of the stake into the uppermost portion of the pocket and thus eliminates distortion of the portion of the pocket over which the screed cap fits.

ADVANTAGES AND SCOPE OF THE INVENTION

As is readily apparent from the claims and from the foregoing description, the system of the present invention obviates many of the inventory, transportation and storage problems of known systems with a significant reducton in cost. The stake may be utilized with screed of four different vertical dimensions, and may be utilized both intermediate the length of the screed and at the ends thereof where joints are required.

The use of the double fingers provides increased gripping and rotational stability to the screed and facilitates joining the screed, i.e., one finger may be used for each of two abutting sections of screed.

The use of a spring biased screed structure at the bottom edge of the screed to provide a frictional bind to the stake is effective, and permits a significant reduction in the amount of metal which must be cut from a stake in order to form fingers with adequate resiliancy. The use of a spring biased screed.

What is claimed is:

1. In a screed stake having a flat top, a pointed bottom, and a longitudinally central stiffening bead, the improvement comprising a pair of upwardly extending fingers formed out of the stake one on each side of the stiffening bead at each of three different distances from the flat top of the stake, all of said fingers being within about 250% of D and the length of each of said fingers being less than about 50 percent of D, where D is the smallest vertical distance between like portions of vertically adjacent pairs of said fingers.

2. The screed stake of claim 1 wherein each of said fingers is generally arcuate with the horizontal spacing between the free end thereof and the stake being less than the thickness of the stake.

3. The screed stake of claim 2 wherein a portion of the stake between said flat top and the vertically highest one of said pairs of fingers is curved out of the plane of the stake toward the finger side of the stake with the flat top of the stake remaining generally in the plane of the stake.

4. The screed stake of claim 1 wherein a portion of the stake between said flat top and the vertically highest one of said pairs of fingers is curved out of the plane of the stake toward the finger side of the stake with the flat top of the stake remaining generally in the plane of the stake.

5. The screed stake of claim 1, including a fourth pair of fingers, all of said fingers being within about 450% of D.

6. The screed stake of claim 5 wherein said stake is bent out of the plane thereof toward said fingers above the uppermost one of said pairs of fingers.

7. In a generally flat elongated screed stake having a flat top, a pointed bottom, a central longitudinal stiffening bead, and a plurality of upwardly pointing fingers formed from the metal of the stake laterally of the stiffening bead, the improvement wherein each of the fingers is formed by a generally upwardly and outwardly extending portion integral with the stake and a generally upwardly and inwardly extending terminal portion.

8. The screed stake of claim 7 wherein said fingers are generally arcuate and are formed in pairs at each of four distances from said flat end.

9. A system for facilitating the pouring of concrete slabs comprising:

four screeds each comprising generally planar elongated sheet of different vertical dimensions having a horizontally extending channel formed in a vertically central portion thereof, the upper edge of said elongated sheet forming a downwardly opening pocket adapted to receive the generally flat upper end of a screed stake, and the lower edge of said elongated sheet being adapted for insertion in a pair of fingers formed on one side of a screed stake; and a plurality of screed stakes each having a flat top, a generally pointed bottom and a longitudinal stiffening bead extending from said bottom to a point adjacent said top, each of said stakes having four vertically spaced pairs of fingers extending therefrom upwardly alongside the stake to form a pocket for receiving the lower edge of said screed when the flat top of said stake is received in the downwardly opening pocket of said screed, whereby a plurality of said stakes may be driven into the ground and said screed positioned with the top of said stake in the downwardly opening pocket formed in the upper edge of said screed and the lower edge of said screed received in the one of said pairs of fingers matching the vertical dimension of said screed so that screeds of any one of four different vertical dimensions may be used with said stakes.

10. The system of claim 9 wherein all four pairs of said fingers are within about 450% of D and the length of said fingers is less than 50% of D, where D is the smallest vertical distance between vertically adjacent pairs of said fingers.

11. The system of claim 10 wherein the lower edge of said screed is provided with a skirt inclined downwardly toward the plane of said screed from a position horizontally displaced therefrom on the side of said screed into which said channel extends.

12. The system of claim 11 wherein the pocket of said screed includes a first downwardly extending portion generally parallel to the plane of said screed and a second portion inclined downwardly and away from the plane of said screed.

13. The system of claim 12 wherein each of said stakes is curved between the uppermost one of said pairs of fingers and said flat top towards said fingers.

14. The system of claim 9 wherein the lower edge of said screed is provided with a skirt inclined downwardly toward the plane of said lower portion from a position horizontally displaced therefrom on the side thereof into which said channel extends; and wherein the pocket of said screed includes a first downwardly extending portion generally parallel to the plane of said screed and a second portion inclined downwardly and away from the plane of said screed.

15. The system of claim 11 wherein each of said stakes is curved between the uppermost one of said pairs of fingers and said flat top towards said fingers.

16. The system of claim 9 wherein each of said stakes is curved between the uppermost one of said pairs of fingers and said flat top towards said fingers.

17. A system for facilitating the pouring of concrete slabs comprising:

four sizes of screed, each comprising an elongated sheet with a generally planar upper and lower portion and a horizontally extending channel formed in a vertically central portion thereof, the upper side of each of said four screeds forming a downwardly opening pocket adapted to receive the generally planar upper end of a screed stake, and the lower side of each of said four screeds being adapted for insertion in a pair of fingers formed on one side of a screed stake, the upper portion of two of said four screeds having a first substantially common dimension and the upper portion of the other two of said screeds having a second substantially common dimension different from said first common dimension, the lower portion of three of said four screeds having a third substantially common dimension less than the dimension of the lower portion of the fourth one of said four screeds, the width of three of the channels in the central portion of said four screeds having a fourth common dimension greater than the width of the channel of the fourth one of said four screeds; and a plurality of screed stakes each having a flat top, a pointed end, a longitudinal stiffening bead and four vertically spaced-pairs of fingers extending therefrom upwardly alongside the stake for receiving the lower edge of one of said four screeds, the top of each of said stakes being adapted to be received in the downwardly opening pocket of said four screeds, whereby said plurality of stakes may be driven into the ground to support a selected one of said four screeds when the lower edge of the selected screed is positioned in the appropriate one of said four pairs of fingers with the downwardly opening pocket formed in the upper edge of the selected screed receiving the flat top of said stakes so that only one of said four screeds may be used with the same plurality of stakes.

18. The system of claim 17 wherein the three uppermost ones of said four pairs of said fingers are within about 250% of D and the length of said fingers is less than 50% of D, where D is the smallest vertical distance between vertically adjacent pairs of said fingers.

19. The system of claim 18 wherein each of said stakes is curved between the uppermost one of said pairs of fingers and said flat top towards said fingers.

20. The system of claim 18 wherein all four of said pairs of fingers are within about 450% of D; and wherein each of said stakes is curved between the uppermost one of said pairs of fingers and said flat top towards said fingers.

21. A system for facilitating the pouring of concrete slabs comprising:

a screed comprising a generally planar elongated sheet having a horizontally extending channel formed in a vertically central portion thereof, the upper edge of said screed forming a downwardly opening pocket adapted to receive the generally flat upper end of a screed stake, the lower edge of said screed being adapted for insertion in a pair of fingers formed on one side of a screed stake; and a plurality of screed stakes each having a flat top, a generally pointed bottom, a longitudinal stiffening bead extending from said bottom to a point adjacent said top, and a pair of fingers extending therefrom upwardly alongside the stake to receive the lower edge of said screed when the flat top of said stake is received in the downwardly opening pocket of said screed, said stakes being curved between said pair of fingers and said flat top towards said fingers, so that said screed is held on said stakes by horizontal pressure (a) between the flat top of said stake and said pocket (b) between the curved portion of said stake and the upper portion of said screed, (c) between said stake and the lower portion of said screed, and (d) between the lower edge of said screed and said fingers.

22. The system of claim 21 wherein the lower edge of said screed is provided with skirt inclined downwardly toward the plane of said screed from a position horizontally displaced from the plane of said screed on the side thereof into which said channel extends; and wherein the ends of said fingers are inclined inwardly toward said stake at the free ends thereof to control said inclined skirt and bind said skirt against said stake.

23. The system of claim 22 wherein the pocket of said screed includes a first downwardly extending portion generally parallel to the plane of said screed and a second portion inclined downwardly and away from the plane of said screed; and wherein the flat top of said stake contacts the inclined portion of the pocket of said screed.

24. The system of claim 21 wherein the pocket of said screed includes a first downwardly extending portion generally parallel to the plane of said screed and a second portion inclined downwardly and away from the plane of said screed; and wherein the flat top of said stake contacts the inclined portion of the pocket of said screed.

25. In an elongated screed having generally coplanar upper and lower portions, a centrally located channel, and a downwardly opening pocket formed by a downwardly extending hem on the upper edge of the upper portion, the improvement wherein said hem includes an upper part downwardly extending alongside said upper portion substantially parallel thereto, a middle part extending away from said upper part, and a lower part inclined downwardly and away from the plane of said upper portion, said lower part being approximately twice the lengths of said upper part;

wherein the lower edge of said screed is provided with a skirt inclined downwardly toward the plane of said screed from a position horizontally displaced therefrom on the side thereof into which said channel extends; and wherein the pocket of said screed includes a front downwardly extending portion generally parallel to the plane of said screed and a second portion inclined downwardly and away from the plane of said screed.

26. In an elongated screed having substantially coplanar upper and lower portions, a centrally located channel and a downwardly opening pocket formed on the upper edge of said upper portion, the improvement wherein said lower portion includes a skirt having a first portion extending generally horizontally away from the plane of the screed in the same direction as said channel and a second portion inclined downwardly toward and terminating in the plane of the screed.

27. A method of securing screed to a stake comprising the steps of:

(a) providing a stake with a flat top, a pointed bottom, a longitudinal stiffening bead and an upwardly extending finger;

(b) placing the stake upright in the earth with the flat top thereof at a preselected elevation;

(c) providing an elongated screed with generally coplanar upper and lower portions and a longitudinal channel therebetween, and a pocket formed by a hem on the top edge thereof, said lower portion having a downwardly extending skirt inclined to the plane of the screed;

(d) inserting the skirt of the screed downwardly between the stake and the upwardly extending finger for approximately 50% of the length of the finger while continuously reducing the angle between the plane of the screed and the plane of the stake from about 10 degrees to about zero degrees to thereby position the upper portion of the screed adjacent the flat top of the stake; and (e) thereafter moving the screed downwardly alongside the stake to thereby simultaneously position the pocket of the screed downwardly over the flat top of the stake and the skirt of the screed downwardly between the finger and the stake.

28. The method of claim 27 wherein the horizontal spacing between the hem of the pocket and the plane of the screed decreases with increasing vertical height so that the insertion of a fixed thickness stake into the pocket effects a frictional bind between the top of the stake and the pocket.

29. The method of claim 28 wherein the horizontal spacing between the skirt and the plane of the screed increases with vertical height so that the downward insertion of the skirt into the fixed horizontal spacing between the end of the finger and the stake effects a frictional bind between the screed and the stake on one side of the screed and the screed and the free end of the finger on the other side of the screed.

30. The method of claim 27 wherein the horizontal spacing between the skirt and the plane of the screed increases with vertical height so that the downward insertion of the skirt into the fixed horizontal spacing between the end of the finger and the stake effects a frictional bind between the screed and the stake on one side of the screed and the screed and the free end of the finger on the other side of the screed.

31. A method of securing screed to a stake comprising the steps of:

(a) providing an elongated screed having substantially coplanar upper and lower portions and a longitudinal channel therebetween, said channel extending into a first side thereof and protruding out of the second side thereof, a surface spaced from and facing the upper portion of the screed on the first side thereof, and a skirt-depending from the lower portion;

(b) providing an upright stake with a flat top, a pointed bottom, a longitudinal stiffening bead extending into a first side thereof and protruding from a second side thereof, and a surface spaced from and facing the first side thereof; and (c) positioning the screed relative to the stake:

(1) with the second side of the stake in contact with the surface of the screed, (2) with the first side of the stake in contact with the upper portion, the lower portion and the free end of the skirt of the screed, all on the first side thereof, and (3) with the second surface of the screed in contact with the surface of the stake, the above points of contact being sufficiently offset from the plane passing approximately therethrough to stress the stake and screed within their elastic limits sufficiently to secure the screed to the stake.

* * * * *